US010806974B1

(12) United States Patent
Biafore, Jr.

(10) Patent No.: US 10,806,974 B1
(45) Date of Patent: Oct. 20, 2020

(54) PUTTER GRIP

(71) Applicant: SSG International, LLC, Wixom, MI (US)

(72) Inventor: John J. Biafore, Jr., Grand Blanc, MI (US)

(73) Assignee: SSG International, LLC, Wixom, MI (US)

( * ) Notice: Subject to any disclaimer, the term of this patent is extended or adjusted under 35 U.S.C. 154(b) by 0 days.

(21) Appl. No.: 16/710,317

(22) Filed: Dec. 11, 2019

Related U.S. Application Data

(63) Continuation-in-part of application No. 16/376,722, filed on Apr. 5, 2019, now Pat. No. 10,716,981.

(51) Int. Cl.

| | |
|---|---|
| ***A63B 53/14*** | (2015.01) |
| ***A63B 53/00*** | (2015.01) |
| ***A63B 60/14*** | (2015.01) |
| *A63B 60/12* | (2015.01) |

(52) U.S. Cl.
CPC ..... *A63B 53/007* (2013.01); *A63B 53/14* (2013.01); *A63B 60/14* (2015.10); *A63B 60/12* (2015.10)

(58) Field of Classification Search
CPC ..... A63B 53/14; A63B 53/007; A63B 60/06; A63B 60/14; A63B 60/12
See application file for complete search history.

(56) References Cited

U.S. PATENT DOCUMENTS

| | | | | |
|---|---|---|---|---|
| 5,398,930 | A * | 3/1995 | Gibson | A63B 53/14 473/201 |
| 5,454,564 | A * | 10/1995 | Kronogard | A63B 53/007 473/201 |
| 5,460,372 | A | 10/1995 | Cook | |
| 5,584,482 | A * | 12/1996 | Huang | D06N 3/14 473/301 |
| 9,005,045 | B2 | 4/2015 | Dingman | |
| D774,612 | S | 12/2016 | Dingman | |
| D794,147 | S | 8/2017 | Davis et al. | |
| 10,500,455 | B1 * | 12/2019 | Cavill | A63B 1/00 |
| 2003/0176234 | A1 * | 9/2003 | Sheets | A63B 53/14 473/300 |

FOREIGN PATENT DOCUMENTS

| | | | | |
|---|---|---|---|---|
| DE | 102011120059 | A1 * | 6/2013 | A63B 53/14 |
| JP | 2006-223817 | * | 8/2006 | |

* cited by examiner

*Primary Examiner* — Stephen L Blau

(74) *Attorney, Agent, or Firm* — Warner, Norcross + Judd LLP

(57) ABSTRACT

An improved putter grip is provided. In one embodiment, the putter grip includes an enlarged heel portion that can be held in the fore-to-aft direction or the side-to-side direction, dependent upon the user's preference. The putter grip includes a front-facing surface between a right side surface and a left side surface. The putter grip also includes a rear-facing surface that is opposite of the front-facing surface. The rear-facing surface includes an upper portion, defining the enlarged heel, a lower portion, and an intermediate portion. The lower portion of the rear-facing surface is spaced apart from the front-facing surface by a reduced distance, and the intermediate portion is a continuous extension of the lower portion. As a result, the front-to-back width of the putter grip is greater in the upper portion than in the lower portion, with the intermediate portion defining a slightly concave exterior curvature.

20 Claims, 22 Drawing Sheets

PUTTER GRIP

CROSS-REFERENCE TO RELATED APPLICATIONS

The present invention is a continuation-in-part of U.S. patent application Ser. No. 16/376,722 filed on Apr. 5, 2019.

FIELD OF THE INVENTION

The present invention generally relates to golf club grips and, more specifically, to putter grips.

BACKGROUND OF THE INVENTION

Various styles of golf club grips are known in the art. Several known golf club grips are intended to facilitate a particular form of swing by a user. However, such grips are restricted with respect to the orientation of the golf club head, do not facilitate square shoulder alignment during execution of a swing, or fail to be ambidextrous without mechanical adjustment.

Known golf club grips suffer at least the above limitations; therefore, there exists a need for a golf club grip that can help facilitate square shoulder alignment during execution of a golf swing by both left-hand-dominant and right-hand-dominant golfers without the need for mechanical adjustment. Further, there exists a need for a golf club grip that may be assembled in a plurality of orientations with respect to a club head without compromising functionality.

SUMMARY OF THE INVENTION

An improved putter grip is provided. In one embodiment, the putter grip includes an enlarged heel portion that can be held in the fore-to-aft direction or the side-to-side direction, dependent upon the user's preference. The putter grip includes an underlisting and a grip sleeve and is symmetrical about a single plane of symmetry extending through a lengthwise axis of the putter grip. The putter grip includes a front-facing surface between a right side surface and a left side surface. The front-facing surface is optionally rounded toward the left side surface and the right side surface along its entire length.

The putter grip also includes a rear-facing surface that is opposite of the front-facing surface. The rear-facing surface includes an upper portion (defining the enlarged heel), a lower portion, and an intermediate portion. The upper portion is optionally rounded toward the left side surface and the right side surface, such that the upper portion of the rear-facing surface mirrors the rounded front-facing surface. The lower portion of the rear-facing surface is spaced apart from the front-facing surface by a reduced distance, and the intermediate portion is a continuous extension of the lower portion. As a result, the front-to-back width of the putter grip is greater in the upper portion than in the lower portion, with the intermediate portion defining a slightly concave exterior curvature.

The putter grip can be assembled to a golf club shaft by inserting the golf club shaft into an opening in the underlisting. The putter grip is then rotated to a desired orientation with respect to a club head, with the putter's enlarged heel being aligned with heel-toe direction of the club head or rotated 90° relative to the heel-toe direction of the club head. The putter grip can be held as a conventional pistol grip, with the enlarged heel closest to the golfer, or can be held in the side-to-side direction if desired. For example, the putter grip can be held with the enlarged heel engaging the anterior (palmer) side of the golfer's left wrist (for right hand dominant golfers) or right wrist (for left-hand dominant golfers) to prevent wrist flexion and wrist extension during a putting stroke. Further by example, the putter grip can be held opposite of a pistol grip with the enlarged heel facing away from the golfer for added stability during a putting stroke.

These and other features and advantages of the present disclosure will become apparent from the following description of particular embodiments, when viewed in accordance with the accompanying drawings and appended claims.

DETAILED DESCRIPTION OF THE CURRENT EMBODIMENTS

Figure 1:
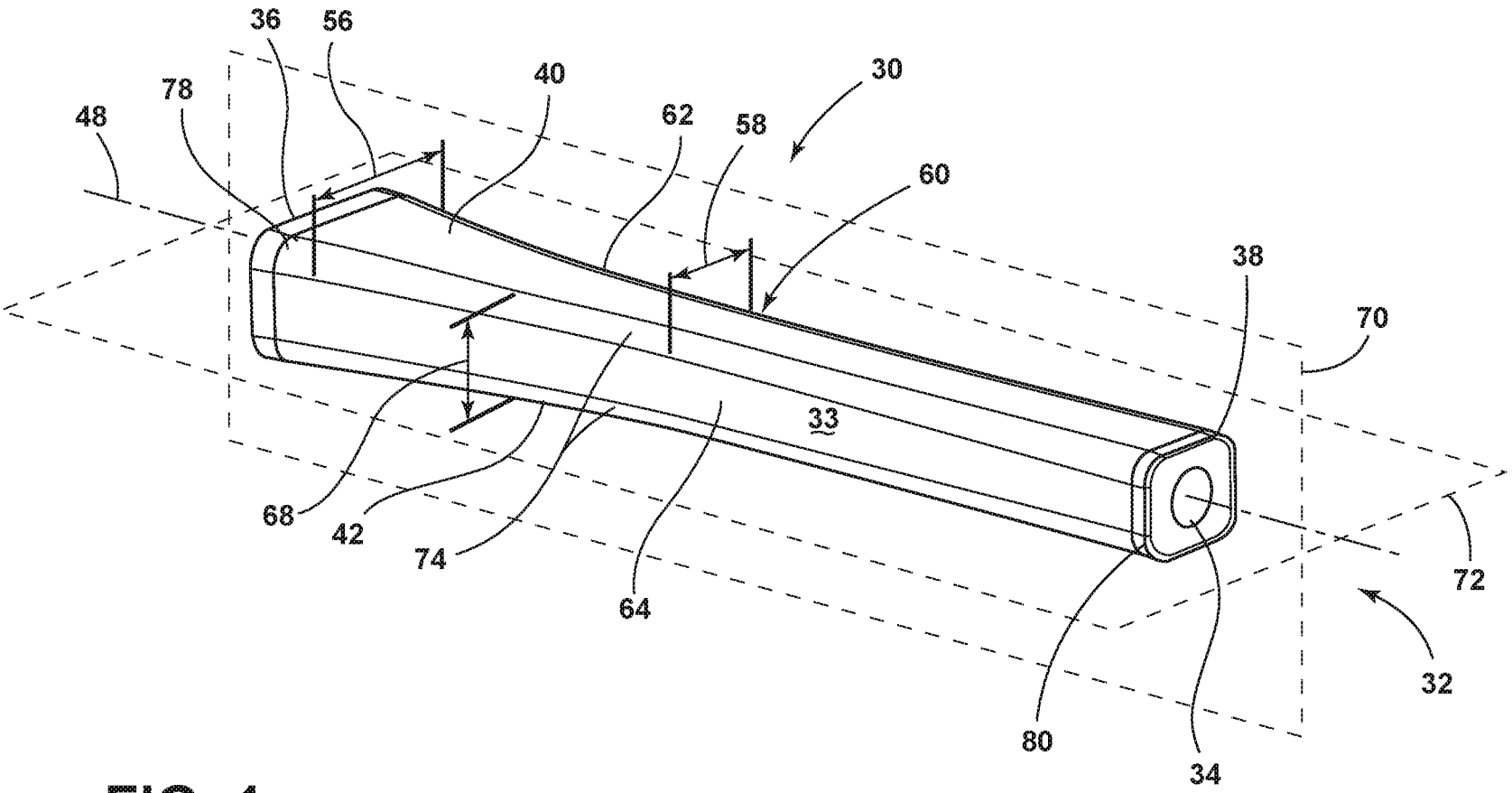
FIG. 1 is a perspective view of a first embodiment of a putter grip.
Figure 2:
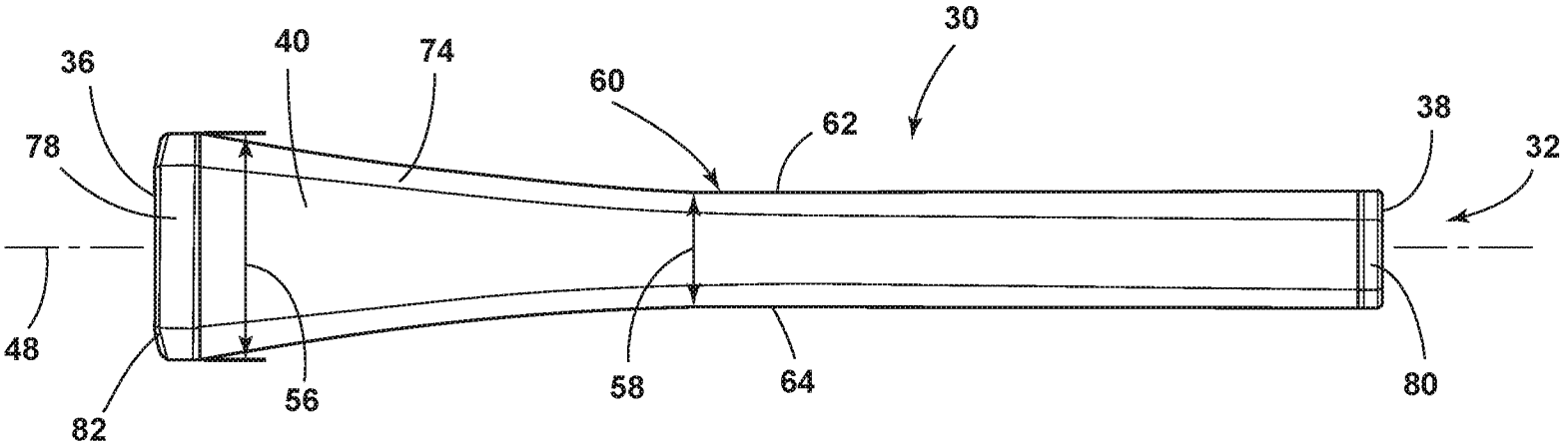
FIG. 2 is a first plan view of the putter grip of FIG. 1.

The current embodiments provide a variety of putters grips having improved functionality over existing grips and having a taper along at least one side thereof. Referring first to FIGS. 1-7, a putter grip in accordance with a first embodiment is illustrated and generally designated 30. The putter grip 30 generally includes a dual-sided pistol configuration having a uniform cross-sectional shape throughout its length. In particular, the putter grip 30 includes an elongated handle 32. The elongated handle 32 has an upper end 36, a lower end 38, a front-facing surface 40, and rear-facing surface 42. Optionally, the front-facing surface 40 and the rear-facing surface 42 are planar and fully mirror each other. Depending on the orientation of the putter grip 30, these surfaces 40, 42 may be oriented in the left-to-right direction, but for consistency, they are termed "front-facing surface" and "rear-facing surface" herein.

As shown in FIG. 1, the elongated handle 32 transitions from a maximum width 56 at the upper end 36 to a minimum width 58 at an intermediate point 60 along the putter grip 30. The intermediate point 60 is optionally mid-way between the upper end 36 and the lower end 38. Alternatively, the intermediate point 60 can be nearer to the upper end 36 or can be nearer to the lower end 38. The elongated handle 32 also includes a first side surface 62 and a second side surface 64. The first side surface 62 and the second side surface 64 slope toward each other along the longitudinal axis 48 of the elongated handle 32 such that a distance between the first side surface 62 and the second side surface 64 is at a maximum at the upper end 36 and decreases in a continuous manner with constant slope. In other words, the first side surface 62 and the second side surface 64 slope toward each other until the intermediate point 60 is reached.

As also shown in FIG. 1, the elongated handle 32 is symmetrical across a first plane 70 and includes an axial opening 34 for a golf club shaft. The first plane 70 is perpendicular to the front-facing surface 40 and the rear-facing surface 42 and intercepts the longitudinal axis 48 of the elongated handle 32. The elongated handle 32 is further symmetrical across a second plane 72. The second plane 72 is perpendicular to the first side surface 62 and the second side surface 64 and intercepts the longitudinal axis 48 of the elongated handle 32. Consequently, the second plane 72 is orthogonal to the first plane 70. The elongated handle 32 generally includes an underlisting and an outer gripping surface 33, which cooperate to provide its three-dimensional structure. The outer gripping surface 33 generally includes a lower durometer than the underlisting, optionally a molded EVA sleeve. In other embodiments, the underlisting and the gripping surface 33 are integrally formed with one another and comprise a unitary putter grip.

Figure 3:
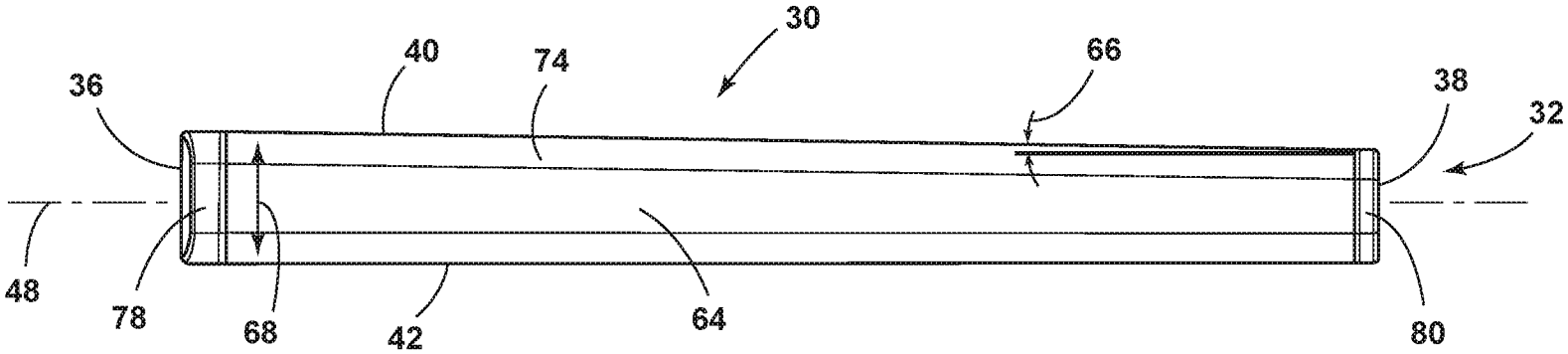
FIG. 3 is second plan view of the putter grip of FIG. 1.
Figure 5:
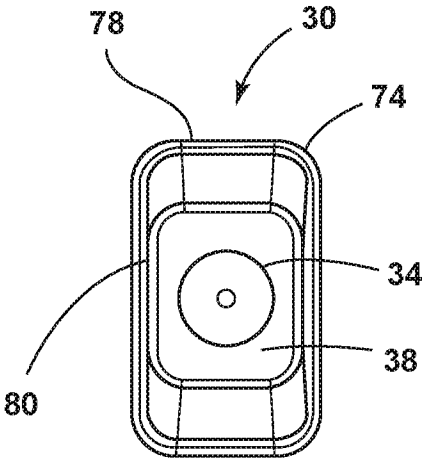
FIG. 5 is a view of the lower end of the putter grip of FIG. 1.

In various embodiments, the first side surface 62 and/or the second side surface 64 is contoured. Optionally, the first side surface 62 and/or the second side surface 64 include a convex contour. Further optionally, the contour may vary as a function of location along the longitudinal axis 48 of the elongated handle 32. For example, a portion of the first side surface 62 proximal to the upper end 36 may conform to a convex contour and a portion of the second side surface 62 proximal to the lower end 38 may be planar. As best shown in FIG. 3, the front-facing surface 40 and the rear-facing surface 42 are planar and form a small angle 66 with the longitudinal axis 48, optionally not more than about five degrees. Accordingly, the distance 68 between the front-facing surface 40 and the rear-facing surface 42 decreases from the upper end 36 to the lower end 38. In other embodiments, the front facing surface 40 and the rear-facing surface 42 are both planar and parallel to each other along their respective lengths.

The elongated handle 32 includes a generally uniform cross-section when taken perpendicular to the longitudinal axis 48. The cross-section includes rounded corners 74 and has a generally rectangular shape in the illustrated embodiment. As discussed below, the cross-section can conform to various other shapes in other embodiments. The dimensions of the cross-section vary as a function of location along the longitudinal axis 48 of the elongated handle 32, while generally preserving its cross-sectional shape as rectangle. Optionally, the shape of the cross-section varies as a function of location along the longitudinal axis 48 of the elongated handle 32.

Figure 4:
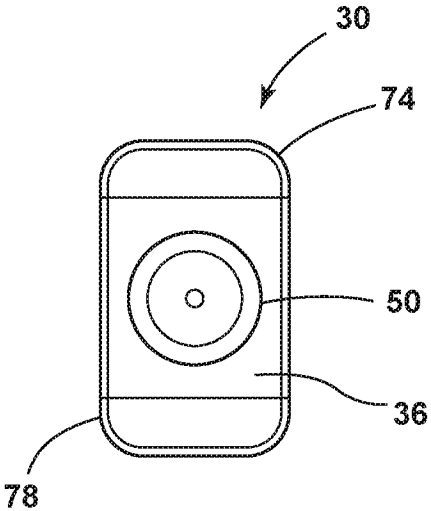
FIG. 4 is a view of the upper end of the putter grip of FIG. 1.
Figure 7:
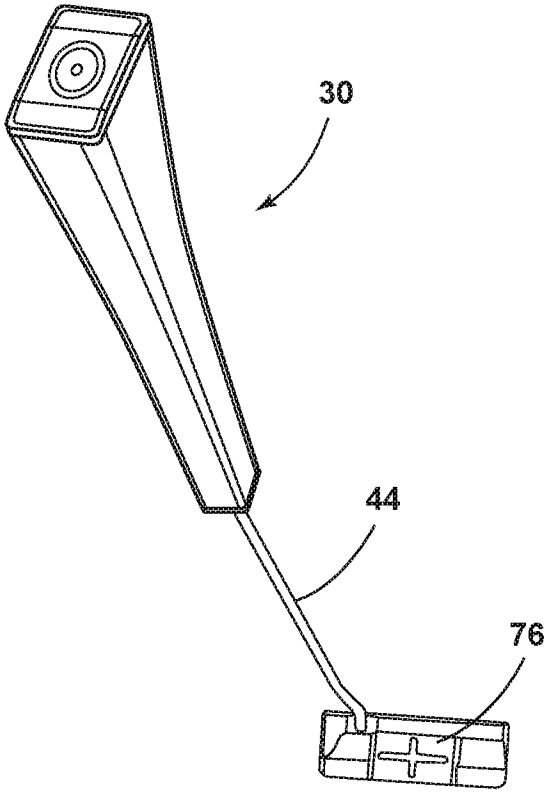
FIG. 7 illustrates the putter grip of FIG. 1 installed in a second orientation.
Figure 6:
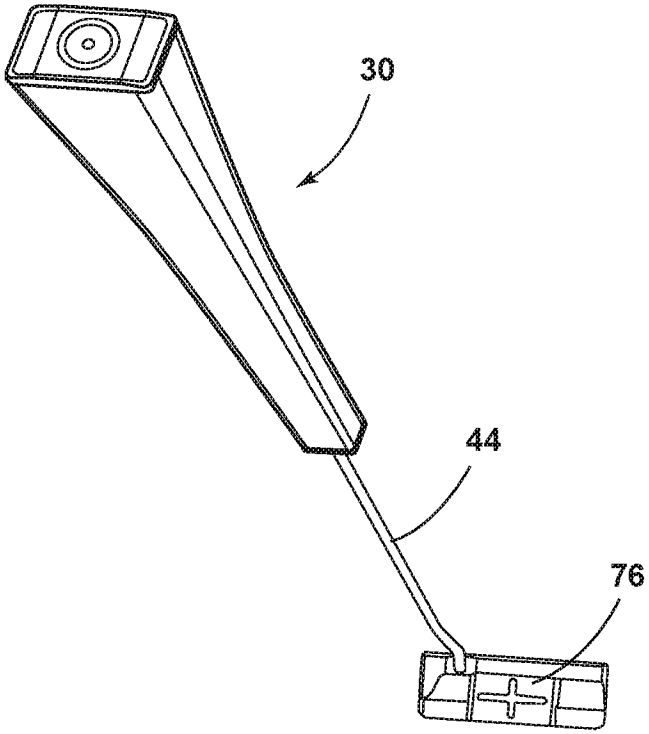
FIG. 6 illustrates the putter grip of FIG. 1 installed in a first orientation.
Figure 8:
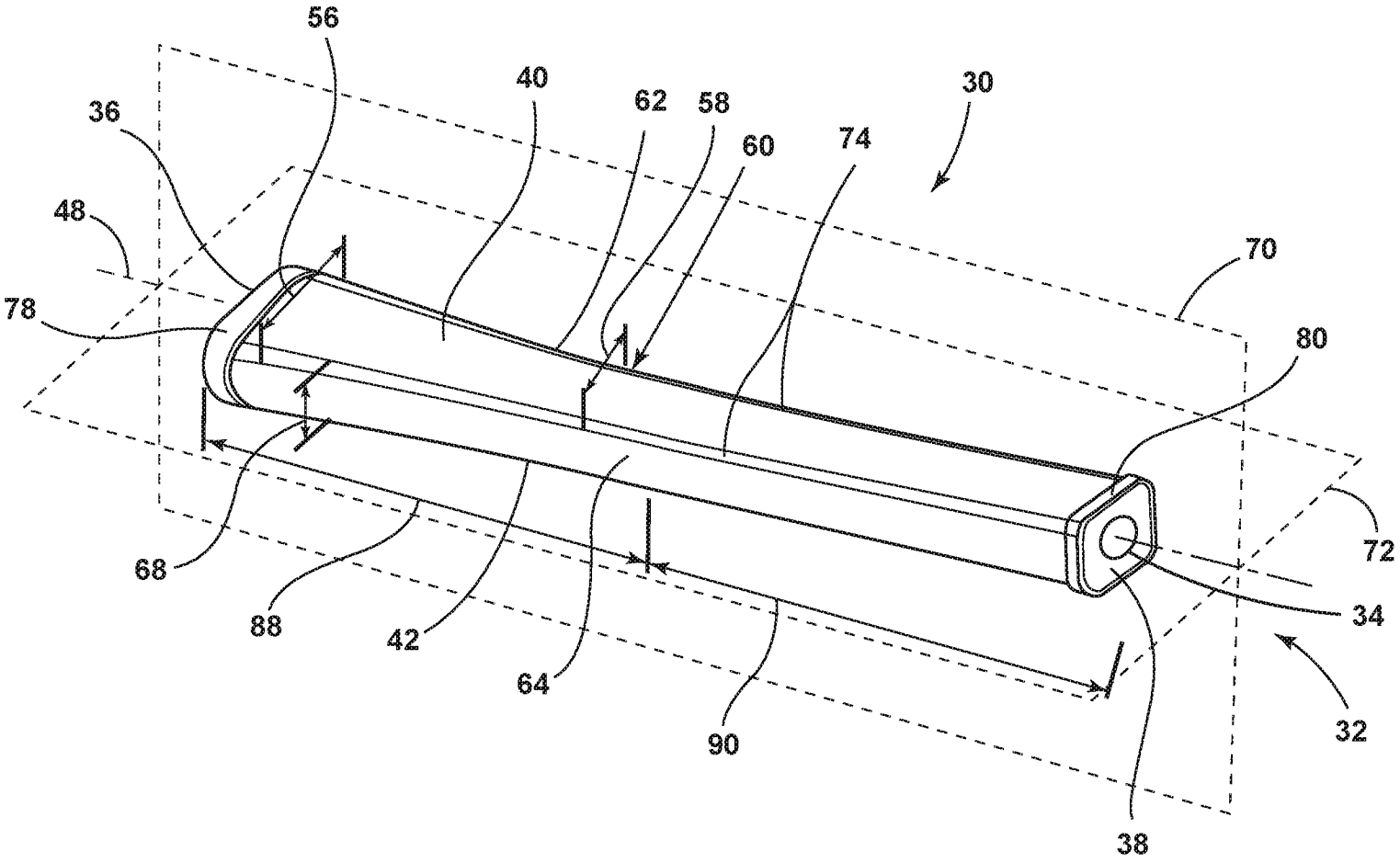
FIG. 8 is a perspective view of a second embodiment of the putter grip.
Figure 9:
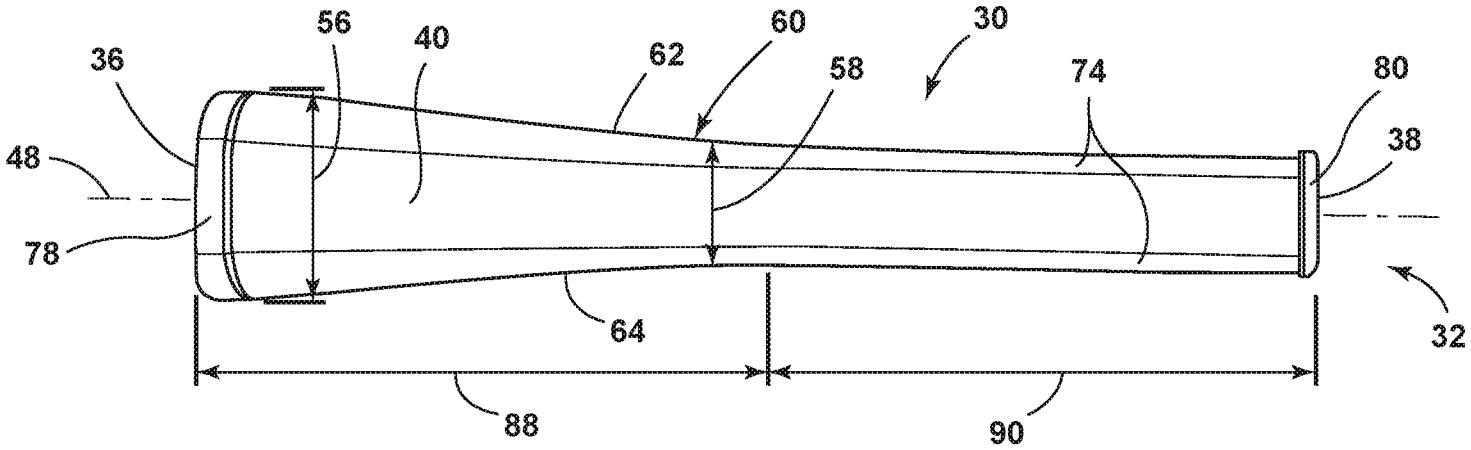
FIG. 9 is a first plan view of the putter grip of FIG. 8.
Figure 10:
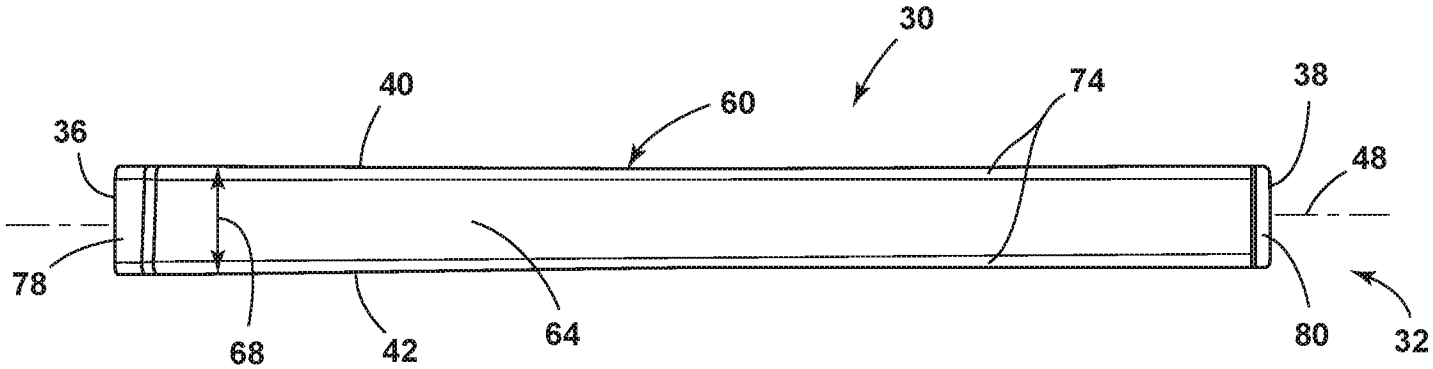
FIG. 10 is a second plan view of the putter grip of FIG. 8.
Figure 12:
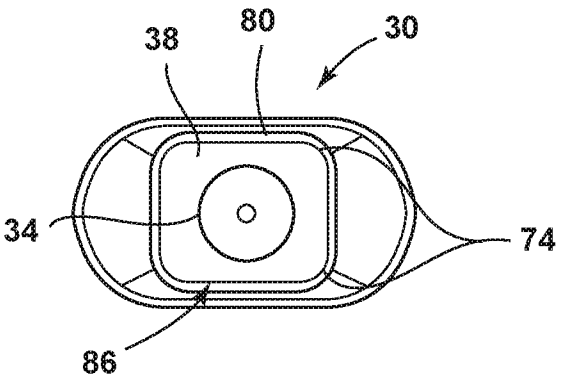
FIG. 12 is a view of the lower end of the putter grip of FIG. 8.
Figure 11:
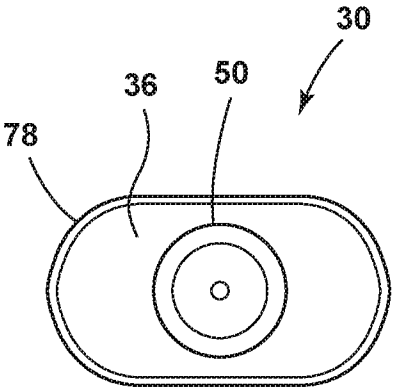
FIG. 11 is a view of the upper end of the putter grip of FIG. 8.
Figure 13:
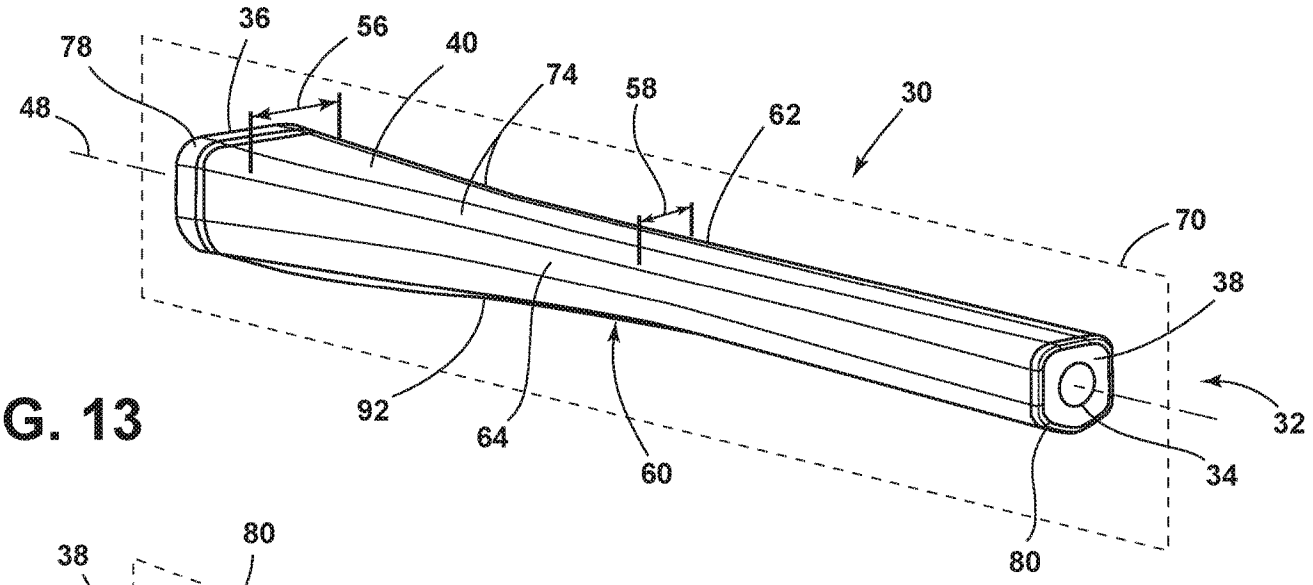
FIG. 13 is a first perspective view of a third embodiment of the putter grip.
Figure 14:
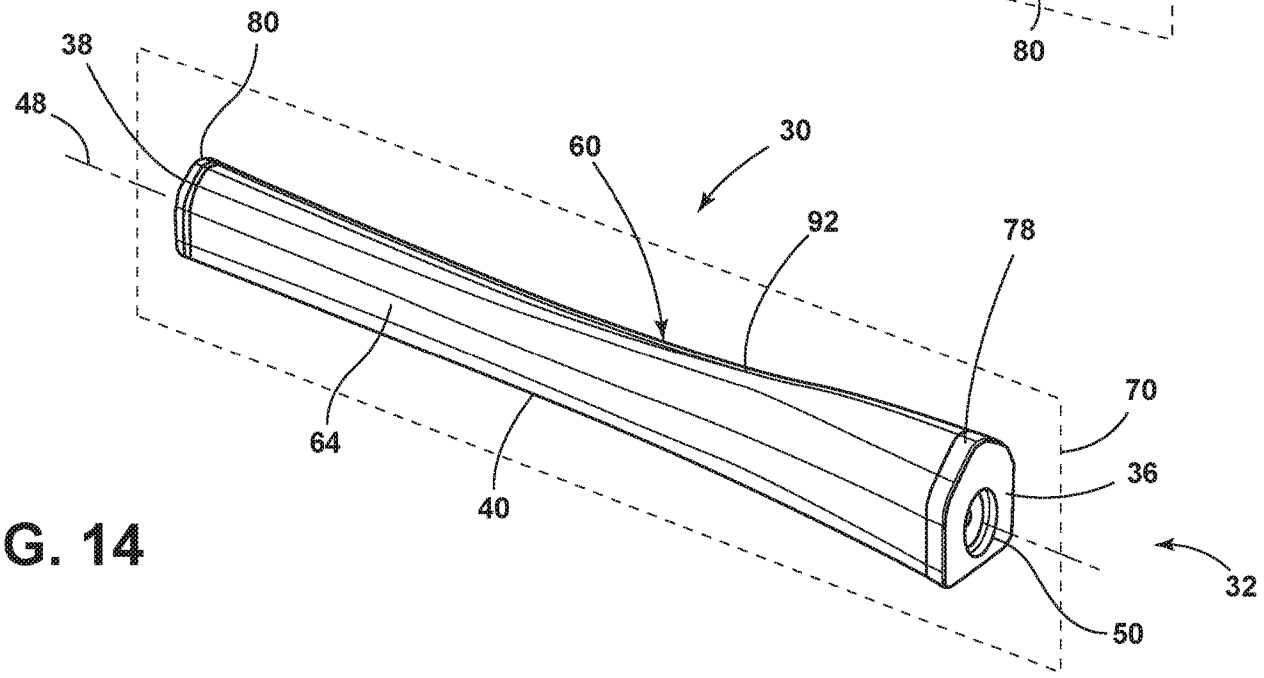
FIG. 14 is a second perspective view of a third embodiment of the putter grip.
Figure 15:
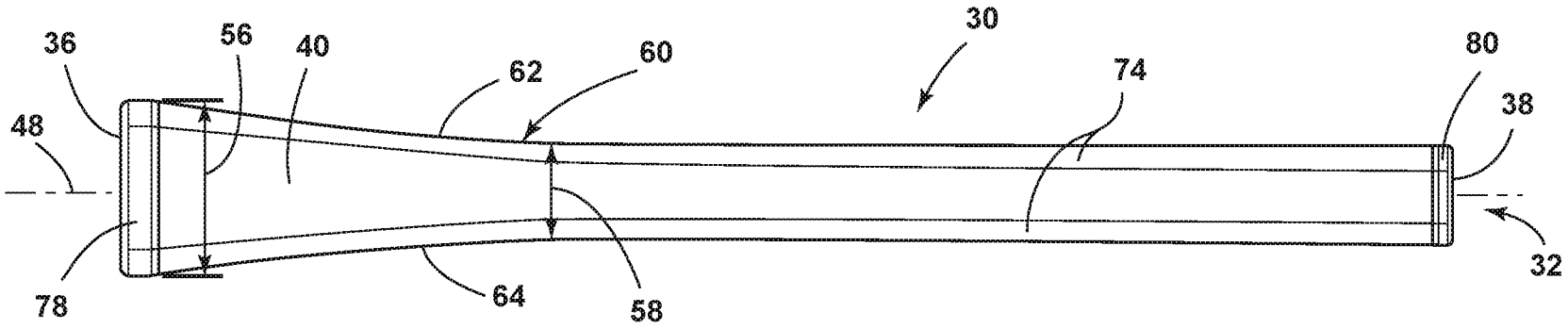
FIG. 15 is a first plan view of the putter grip of FIG. 13.
Figure 16:
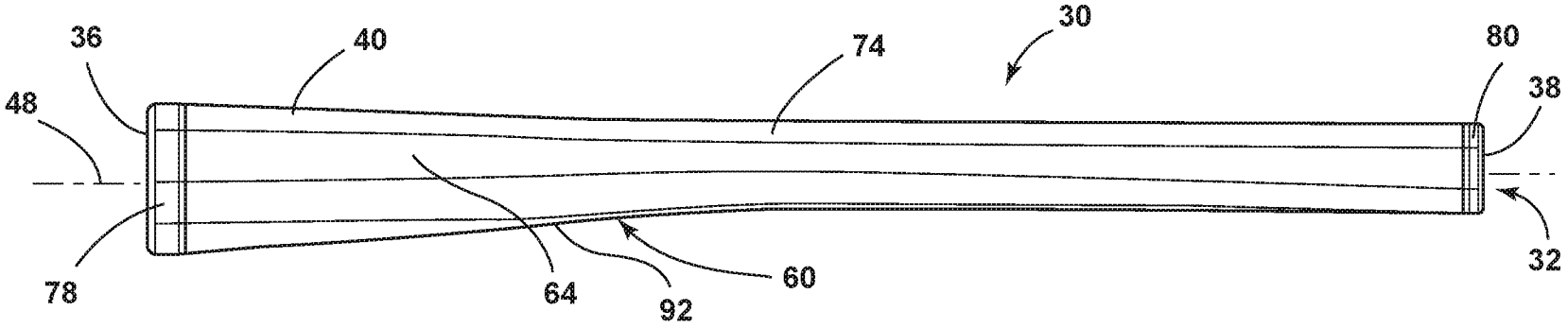
FIG. 16 is a second plan view of the putter grip of FIG. 13.

As noted above, the elongated handle 32 includes an underlisting, the underlisting having an upper peripheral flange 78 and a lower peripheral flange 80, with the outer gripping surface 33 extending therebetween. As shown in FIG. 4, the upper end 36 defines an upper aperture 50 for an end cap comprising a sensor or other device. The putter grip 30 may be assembled to a golf club shaft 44 in a variety of orientations with respect to a golf club head 76. As shown in FIG. 6 for example, the flared upper portion of the elongated handle 32 can align with the toe and heel of the putter head 76. As alternatively shown in FIG. 7, the flared upper portion of the elongated handle 32 can align with the striking face of the putter head 76. In each orientation, the putter grip 30 helps maintain square shoulders during execution of a putter swing.

Referring to FIGS. 8-12, wherein like numerals indicate corresponding parts throughout the several views, a second embodiment of the putter grip 30 is illustrated. The second embodiment of the putter grip 30 differs from the first embodiment of the putter grip 30 primarily with regard to a cross-section(s) defined along a length of the elongated handle 32 and taken perpendicular to the longitudinal axis 48. In particular, the elongated handle 32 of the second embodiment includes a first cross-section and a second cross section perpendicular to the longitudinal axis 48. The first cross-section defines a first shape and the second cross section defines a second shape. The elongated handle 32 defines the first cross-section along a first length 88 of the elongated handle 32 and the elongated handle 32 defines the second cross-section along a second length 90 of the elongated handle 32. Optionally, the sum of the first length 88 and the second length 90 is equivalent to a distance between the upper end 36 and the lower end 38. Optionally, the first length 88 and the second length 90 meet at the intermediate point 60.

The second cross-section is different in shape and dimension from the first cross section. The first shape includes two planar surfaces 40, 42 disposed opposite one another and two convex surfaces 62, 64 disposed opposite one another. The second shape is rectangular and includes rounded edges 74. The dimensionality of the first shape varies as a function of distance from the upper end 36 measured along the longitudinal axis 48. Optionally, the elongated handle 32 includes a transition length (not shown) disposed between the first length 88 and the second length 90. The elongated handle 32 includes along the transition length thereof cross-sections representing transitions between the first shape and the second shape. The two convex surfaces 62, 64 are defined by the first side surface 62 and the second side surface 64, respectively, and the two planar surfaces 40, 42 are defined by the front-facing surface 40 and the rear-facing surface 42, respectively. In various embodiments, the first shape may be any of various shapes and the second shape may be any of various other shapes; however, the first shape and the second shape are distinct from one another in this embodiment.

Referring to FIGS. 13-18, wherein like numerals indicate corresponding parts throughout the several views, a third embodiment of the putter grip 30 is illustrated. The third embodiment of the putter grip 30 differs from the first and second embodiments of the putter grip 30 discussed above primarily with regard to a cross-section(s) along a length of the elongated handle 32 taken perpendicular to the longitudinal axis 48. The cross section conforms to an irregular pentagon (shown in FIGS. 17-18) with at least one side 94 longer than one of the other sides. The longer side 94 sides is defined by the front-facing surface 40, which is sufficiently wide to serve as a point of attachment for left and right thumbs. The shape of the cross-section is generally constant throughout a length of the elongated handle 32 running from the upper end 36 to the lower end 38; however, the dimensionality of the cross-section varies as a function of position along the longitudinal axis 48 such that the dimensions of a cross-section more proximal to the lower end 38 are generally smaller than corresponding dimensions of a cross-section more proximal to the upper end 36. The cross-section also includes rounded edges 74.

Figure 18:
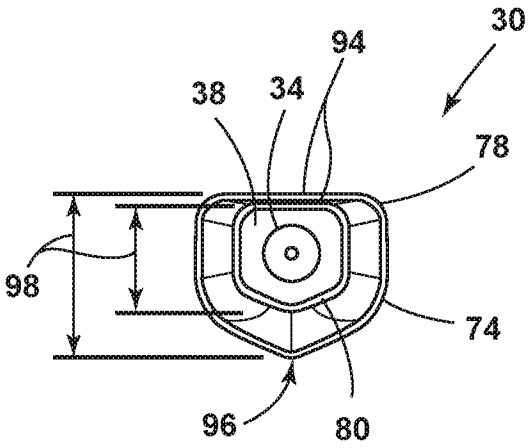
FIG. 18 is a view of the lower end of the putter grip of FIG. 13.
Figure 17:
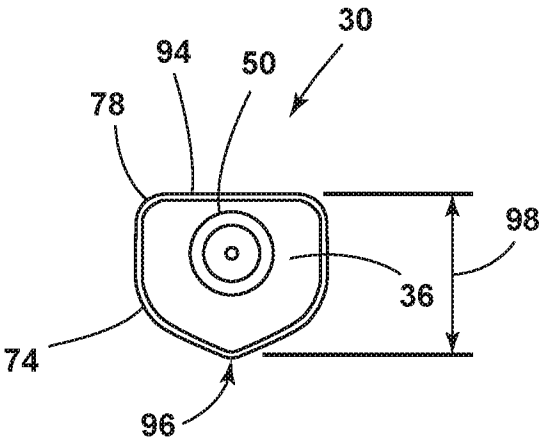
FIG. 17 is a view of the upper end of the putter grip of FIG. 13.
Figure 19:
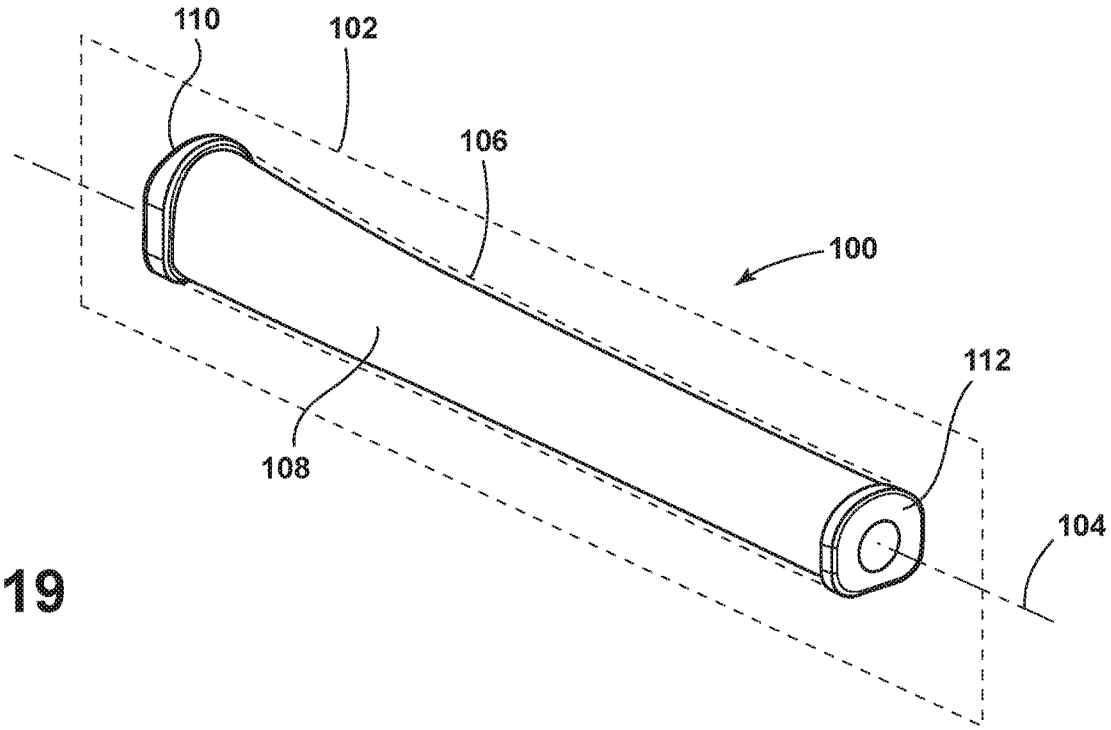
FIG. 19 is a first perspective view of a fourth embodiment of the putter grip.
Figure 20:
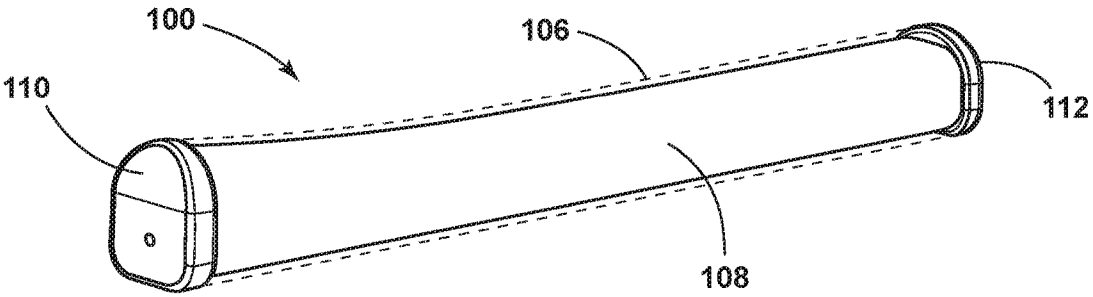
FIG. 20 is a second perspective view of the putter grip of FIG. 19.

As also shown in FIGS. 17-18, the cross-section includes a vertex 96 opposite the planar front-facing surface 40. The vertex 96 provide a raised point of contact for one's fingers, and the vertex 96 and the front-facing surface 40 are separated by a distance 98. The distance 98 is at its greatest at the upper end 36 and is at its smallest at the lower end 38. The vertex 96 conforms to a contour until the distance 98 reaches its minimum at a point proximal to the intermediate point 60. The contour can include an inflection point 92. While described as an irregular pentagon, other cross-sectional shapes can be used in other embodiments, including ovals, circles, and polygons for example. Further, the cross-sectional shape along the upper portion of the elongated handle 32 can differ from the cross-sectional shape along the lower portion of the elongated handle 32 as described above in connection with the second embodiment.

A fourth embodiment of the putter grip is illustrated in FIGS. 19-25 and generally designated 100. The putter grip 100 differs from the embodiments described above in that the putter grip 100 includes only a single-sided pistol taper. Consequently, the putter grip 100 is symmetrical about a single plane of symmetry 102, the plane of symmetry 102 intersecting its longitudinal axis 104. As discussed below, the putter grip 100 transitions from a maximum front-to-back width at an upper end thereof to a minimum front-to-back width at an intermediate point thereof, the minimum width continuing to a lower end thereof.

More specifically, the putter grip 100 includes an outer covering 106 (shown in phantom in FIGS. 19-20) and an underlisting 108. The outer covering 106 generally conforms to the shape of the underlisting 108. The outer covering 106 may be textured to provide a gripping surface, and can be formed of polyurethane for example. The outer covering may be molded directly onto the underlisting or may be manufactured separately and secured to the underlisting. Further optionally, the outer covering and the underlisting may be integrally formed with one another. The underlisting 108 is generally rectangular in cross-sectional shape at the lower end thereof and has a single-sided pistol taper at the upper end thereof, with a smooth transition therebetween. The underlisting 108 also includes an upper end cap 110 and a lower end cap 112.

Figure 21:
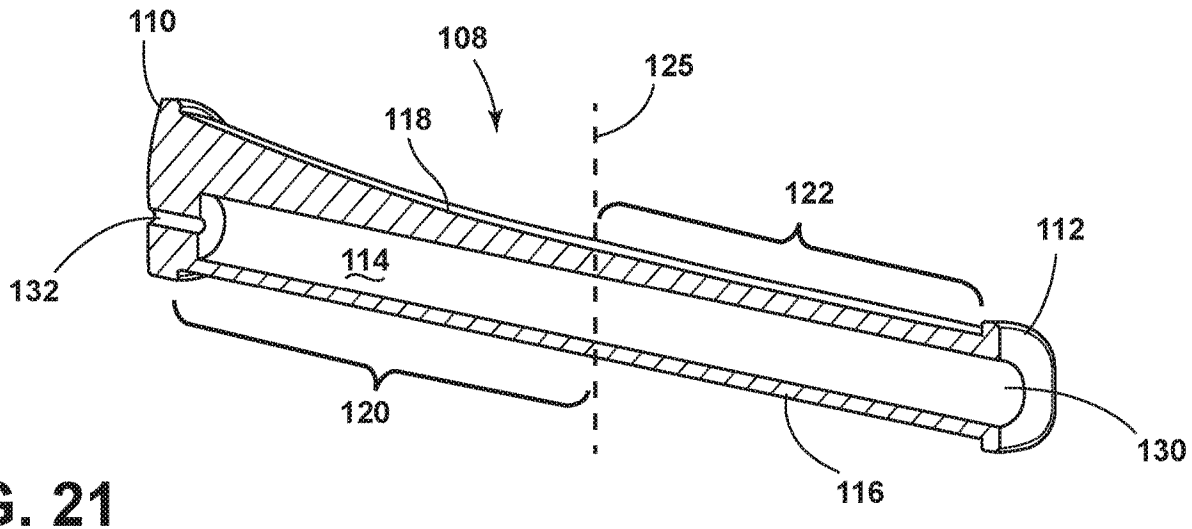
FIG. 21 is a cross-sectional view of the putter grip of FIG. 19.
Figure 22:
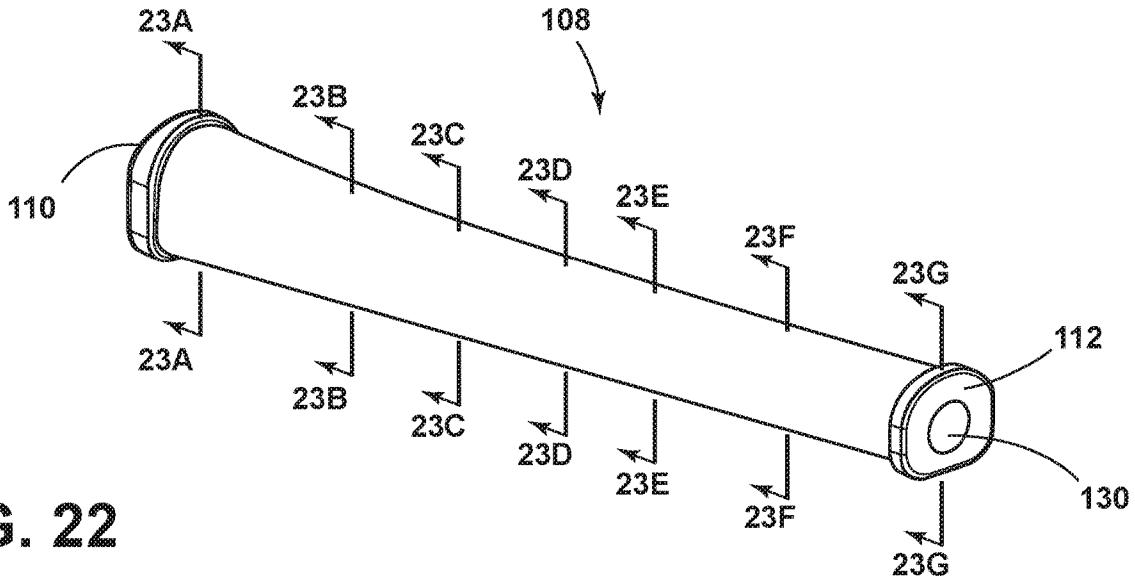
FIG. 22 is a further perspective view of the putter grip of FIG. 19.
Figure 23A:
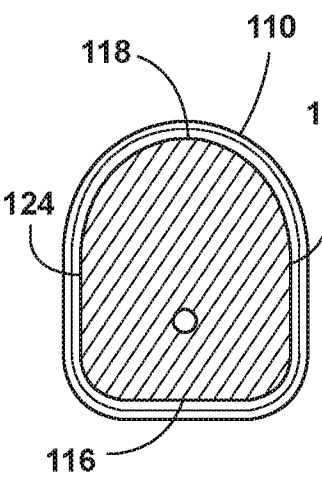
FIGS. 23A-23G are cross-sectional views of the putter grip of FIG. 19 at various planes as shown in FIG. 22.
Figure 23B:
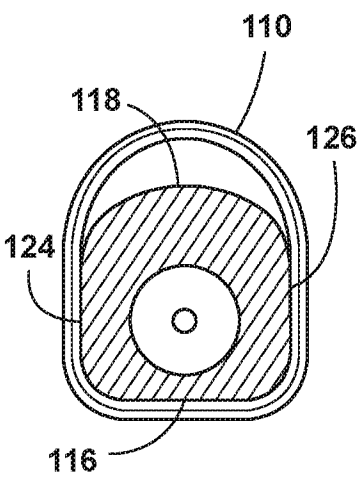
Figure 23C:
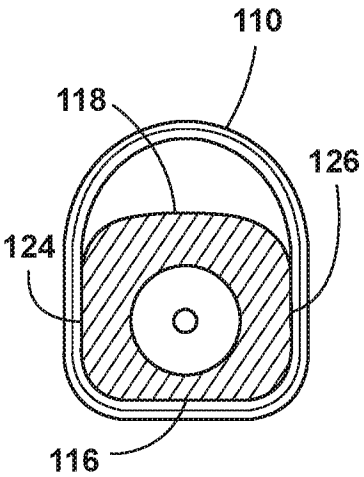
Figure 23D:
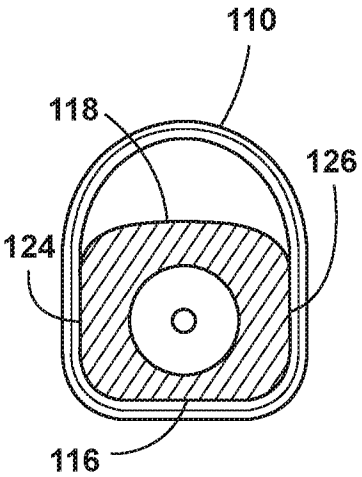
Figure 23E:
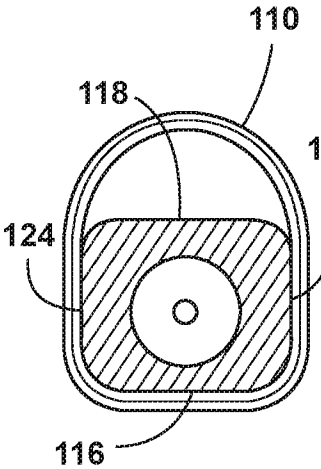
Figure 23F:
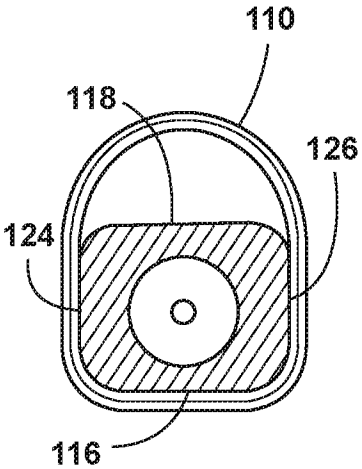
Figure 23G:
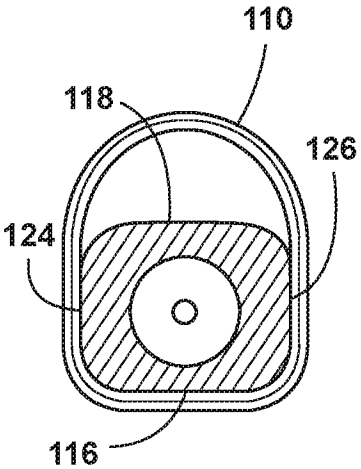
Figure 24:
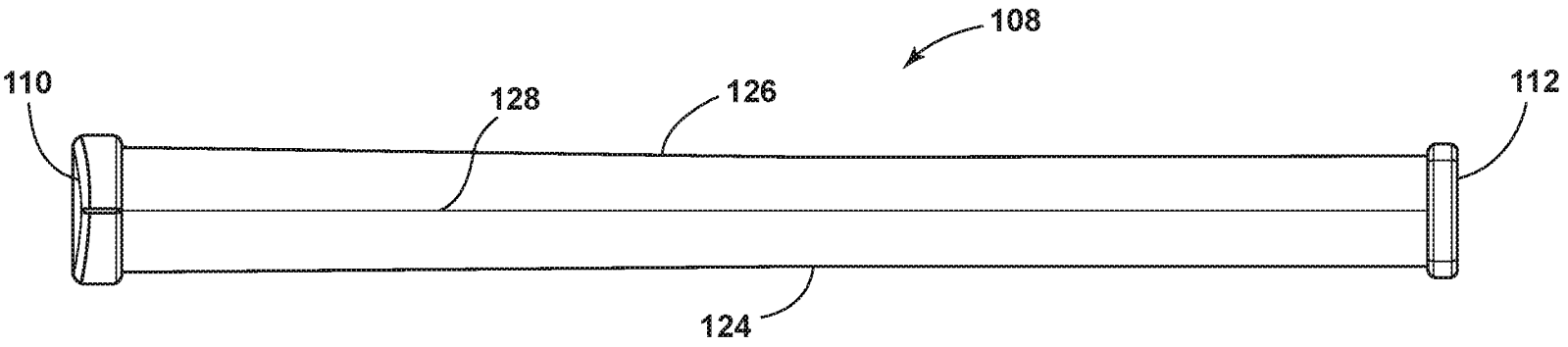
FIG. 24 is a plan view of the putter grip of FIG. 19 including a reminder element or a vertex along the rear-facing surface of the underlisting.
Figure 25:
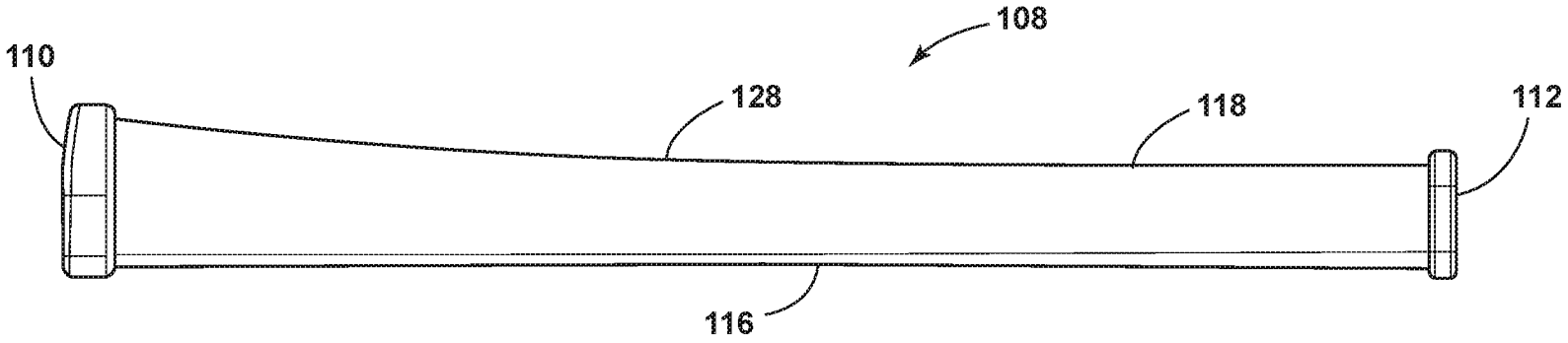
FIG. 25 is a side elevation view of the putter grip of FIG. 24.

Referring to FIG. 21-22, the underlisting 108 is shown in greater detail. The underlisting 108 is a generally hollow structure having a cavity 114 that extends substantially the entire length of the underlisting, but terminates short of the upper end cap 110. The cavity 114 has a generally uniform cross-section through its length for receiving a golf club shaft. The underlisting 108 is further defined by a generally planar front-facing surface 116. In one exemplary embodiment, the width of the front-facing surface 116 tapers slightly. Similarly, the rear-facing surface 118, opposite the front-facing surface 116, is also defined by a side-to-side width that is uniform or that is slightly tapered. In an upper portion 120 of the underlisting, the rear-facing surface 118 is sloped relative to and toward the front-facing surface 116. In the lower portion 122 of the underlisting, the rear-facing surface 118 is generally parallel to the front-facing surface 116 in a lower portion 122 of the underlisting.

Referring to FIGS. 23A-23G, the first and second side surfaces 124,126 generally mirror each other throughout the length of the underlisting, gradually shortening until an intermediate point 125 is reached. The front-facing surface 116 is generally planar throughout its length. The rear-facing surface 118 in the upper portion 120 of the underlisting 108 is contoured to correspond to the contour of the upper end cap 110. The rear-facing surface 118 in the lower portion 122 of the underlisting 108 is generally flat with rounded or beveled edges. As optionally shown in FIGS. 24-25, the rear-facing surface 118 can include a reminder element 128, similar to the vertex 92 of FIG. 14, along at least a portion of the bottom surface of the underlisting or outer covering. In other embodiments, the reminder element 128 does not extend into the lower portion 120, which instead flattens out after the transition point 125 to form a rectangular cross-sectional shape in cooperation with the planar front-facing surface 116 of the underlisting.

The golf grip 100 is assembled to a golf shaft by introducing the golf shaft through an opening 130 in the lower end cap 112 and into the cavity 114 formed within the underlisting 108. The golf grip 100 may be rotated to position the golf grip to a desired position with respect to a club face. Air may be expelled through the opening 132 in the upper end cap 110 to facilitate engagement of the golf shaft into the cavity 114. Once positioned, the golf grip may be fixed to the golf shaft by any method, including the use of an upper clamp assembly and a lower clamp assembly, whether now known or hereinafter developed.

Figure 26:
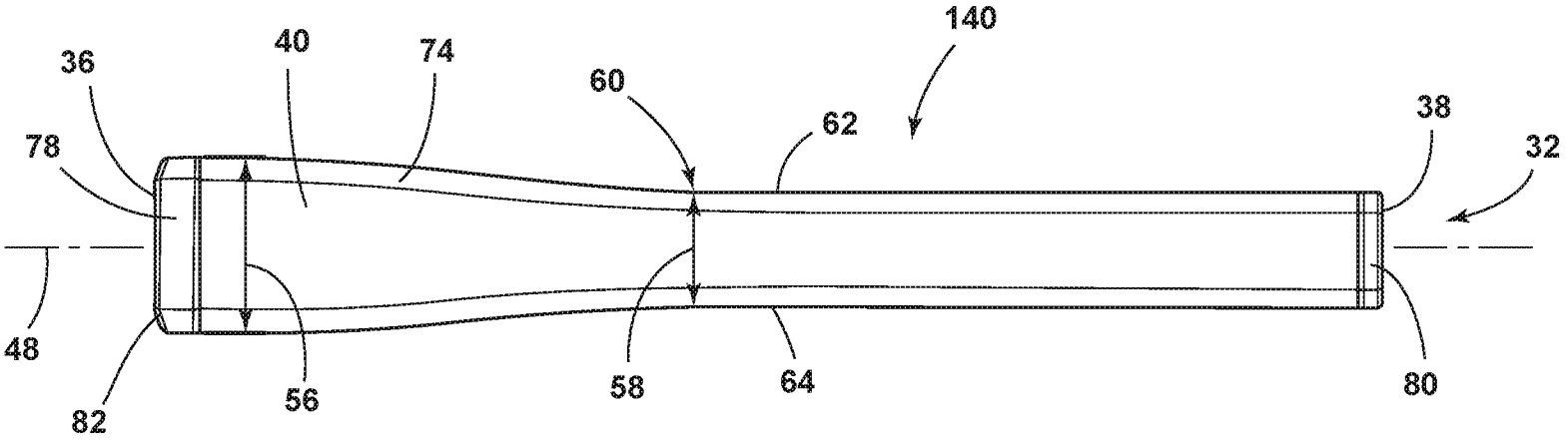
FIG. 26 is a first plan view of a fifth embodiment of a putter grip.
Figure 27:
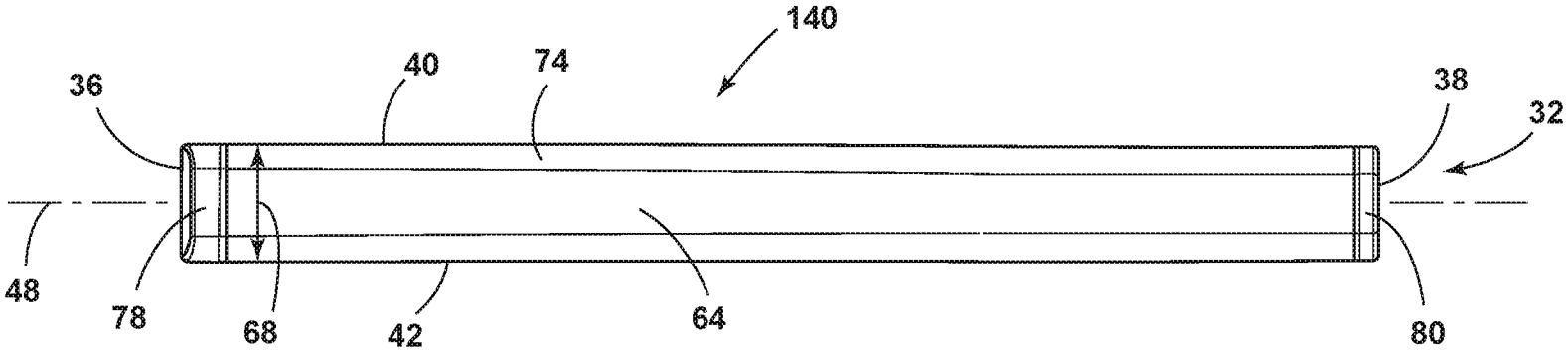
FIG. 27 is a second plan view of the putter grip of FIG. 26.

A fifth embodiment of the putter grip is illustrated in FIGS. 26-27 and generally designated 140. The putter grip 140 of FIGS. 26-27 differs from the first embodiment described above in connection with FIGS. 1-7 in that the putter grip 140 includes a minimal taper, e.g., having an angle-of-taper of less than twenty degrees, further optionally less than fifteen degrees. As used herein, "angle-of-taper" means the angle defined between the longitudinal axis 48 and the sloped side surface 62 or 64. To achieve this minimal taper, the minimum side-to-side width 58 of the elongated handle 32 is greater than 50% of the maximum side-to-side width 56, where the "side-to-side width" is taken from a first side 60 to a second side 62, perpendicular to the longitudinal axis 48 of the elongated handle 32. For example, the minimum width 58 can be greater than 90% of the maximum width 56. As the intermediate point 60 moves away from the upper end 36, the minimum width 58 can comprise a lesser fraction of the maximum width 56 and the elongated handle can still define an angle-of-taper less than twenty degrees. Further by example, the minimum width 58 can be greater than 90% of the maximum width 56 while maintaining an angle-of-taper of less than twenty degrees.

The putter grip 140 is otherwise functionally and structurally similar to the putter grip 30 of FIGS. 1-7. As best shown in FIG. 27, the front-facing surface 40 and the rear-facing surface 42 are planar and are parallel to each other along their respective lengths. The putter grip 140 is symmetrical about a single plane of symmetry intersecting its longitudinal axis 48, the putter grip 140 having a maximum side-to-side width 56 at an upper end thereof and a minimum side-to-side width 58 at an intermediate point thereof, the minimum width continuing to a lower end thereof. As discussed above, the first side surface 62 and the second side surface 64 slope toward each other along the longitudinal axis 48 of the elongated handle 32 such that a distance between the first side surface 62 and the second side surface 64 decreases in a continuous manner with constant slope, until the intermediate point 60 is reached.

Figure 28:
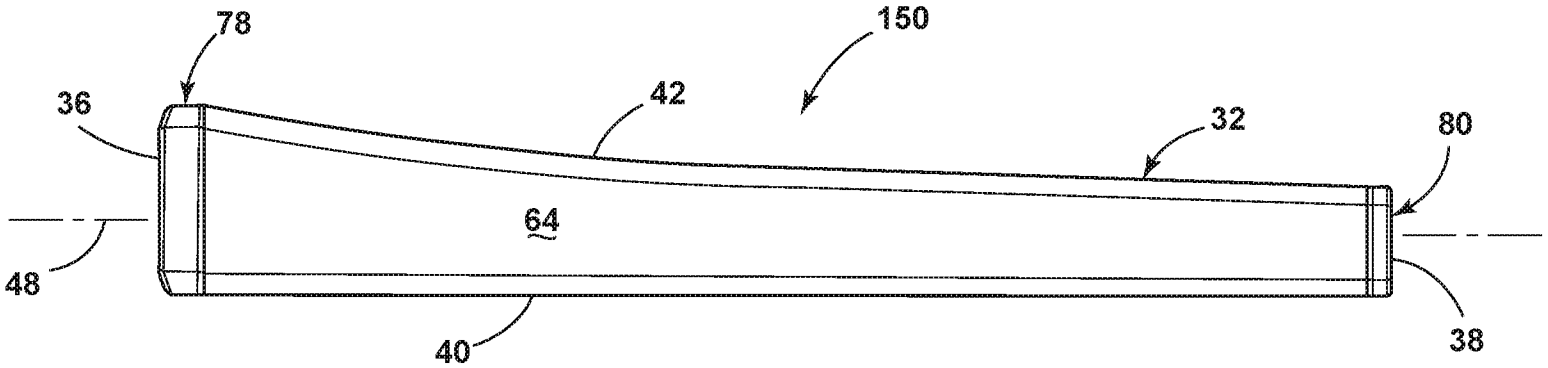
FIG. 28 is a first plan view of a sixth embodiment of a putter grip.
Figure 29:
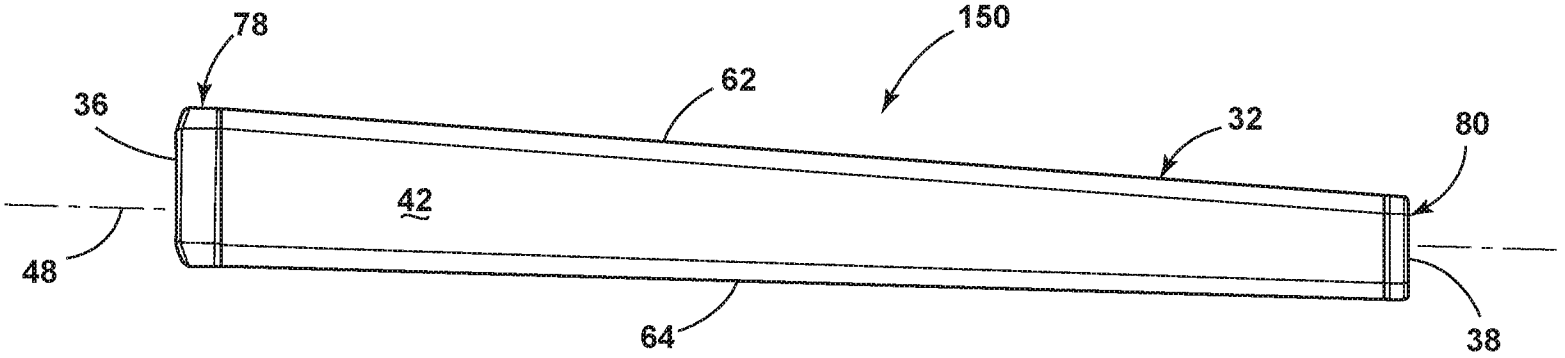
FIG. 29 is a second plan view of the putter grip of FIG. 28.
Figure 31:
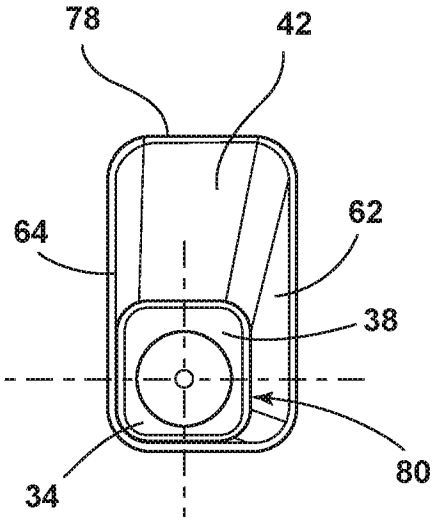
FIG. 31 is a view of the lower end of the putter grip of FIG. 28.
Figure 30:
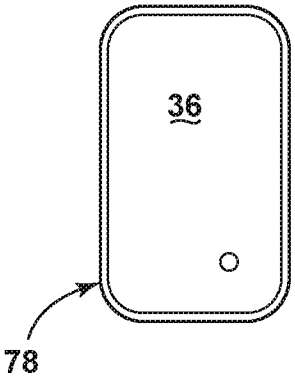
FIG. 30 is a view of the upper end of the putter grip of FIG. 28.

A sixth embodiment of the putter grip is illustrated in FIGS. 28-31 and generally designated 150. The putter grip 150 differs from the embodiments described above in that a portion of the putter grip 150 is completely asymmetrical about its longitudinal axis 48. In particular, the putter grip 150 includes a front-facing surface 40 that adheres to a different contour than a rear-facing surface 42 and includes a first side surface 62 that adheres to a different contour than a second side-surface 64. As shown in FIG. 28 for example, the putter grip 150 includes a rear-facing surface 42 that slopes upwardly toward the upper end 36 of the elongated handle 32 along an upper portion thereof. The front-facing surface 40, by contrast, is planar along its entire length. As shown in FIG. 29, the first side surface 62 is angled relative to the longitudinal axis 48 along length of the elongated handle 32. The second side-surface, by contrast, is planar along its entire length. Because each surface adheres to a different contour than its opposite surface, at least a portion of the putter grip 150 is asymmetrical when viewed from any perspective about the longitudinal axis 48. The asymmetry of the upper portion of the putter grip 150 is perhaps best shown in FIG. 31. As shown, the rear-facing surface 42 slopes downwardly from the upper end 36 of the putter grip while the front-facing surface 40 remains planar. As also shown, the first side surface 62 slopes inwardly from the upper end 36 of the putter grip while the second side-surface 64 remains planar. As a result, the lower end cap 80 is offset with respect to the upper end cap 78 in the front-to-rear direction and in the side-to-side direction, while the elongated handle generally retains a rectangular cross-section throughout its length. In other embodiments, the lower portion of the putter grip 150 is symmetrical about a first plane perpendicular to the front and rear facing surfaces 40, 42 and a second plane that is perpendicular to the first and second side surfaces 62, 64. In still other embodiments, the putter grip 150 can be asymmetrical along a lower portion thereof and symmetrical along an upper portion thereof.

A seventh embodiment of the putter grip is illustrated in FIGS. 32-41 and generally designated 200. The putter grip 200 of this embodiment is similar to the putter grip 100 of FIGS. 19-25, in that both putter grips 100,200 includes an elongated handle having a single-sided pistol taper with parallel or substantially parallel sidewalls. Consequently, the putter grip 200 is symmetrical about a single plane of symmetry 202 intersecting its longitudinal axis 204. The putter grip 200 maintains a maximum front-to-back width along an upper portion thereof and transitions from this maximum front-to-back width to a minimum front-to-back width, the minimum front-to-back width continuing along a lower portion of the putter grip 200.

Figure 32:
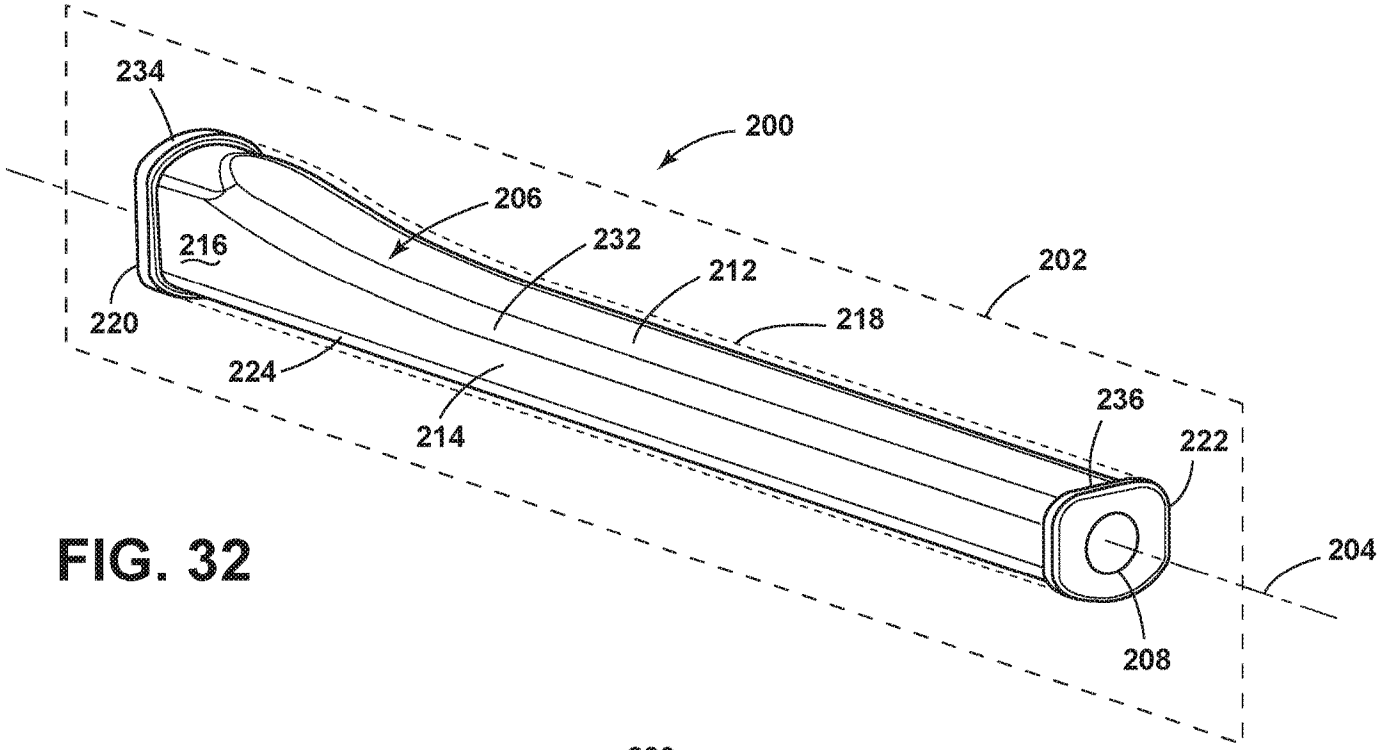
FIG. 32 is a first perspective view of a seventh embodiment of a putter grip.
Figure 33:
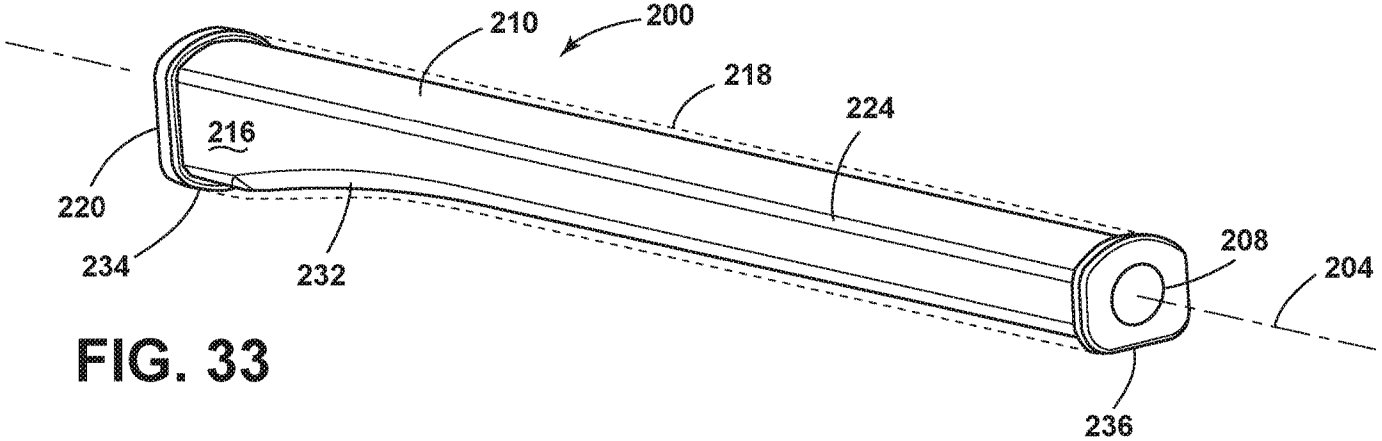
FIG. 33 is a second perspective view of the putter grip of FIG. 32.
Figure 34:
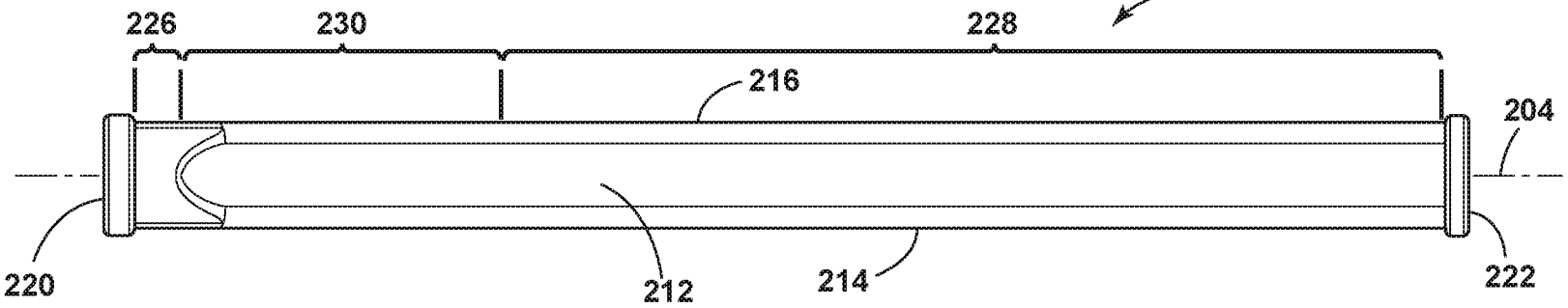
FIG. 34 is a first plan view of the putter grip of FIG. 32.

As shown in FIGS. 32 and 33, the putter grip 200 includes an underlisting 206 that defines an opening 208 for receiving a golf club shaft. The underlisting 206 is a hollow, four-sided structure comprising a front-facing surface 210, a rear-facing surface 212, a first side-surface 214, and a second side surface 216. Depending on the orientation of the putter grip 200, the front-facing surface 210 and the rear-facing surface 212 may be oriented in the left-to-right direction or the right-to-left direction, but for consistency, they are termed "front-facing surface" and "rear-facing surface" herein. The underlisting 206 is substantially rigid and provides dimensional stability for a grip sleeve 218. The grip sleeve 218 (shown in phantom in FIGS. 32 and 33) conforms to the shape of the underlisting 206 between an upper end cap 220 an a lower end cap 222, such that the outer surface of the putter grip 206 is identical to the outer surface of the underlisting 206. The grip sleeve 218 can be textured and can be formed of polyurethane for example, being molded directly onto the underlisting 206 or manufactured separately from the underlisting 206. Further optionally, the grip sleeve 218 and the underlisting 206 may be integrally formed with one another.

In the illustrated embodiment, the grip sleeve 218 is even with the upper end cap 220 and the lower end cap 222. In addition, the first side surface 214 and the second side surface 216 are planar and fully mirror each other. The underlisting 206, and consequently the grip sleeve 218, include a side-to-side width that is constant between the upper end cap 220 and the lower end cap 222. The front-facing surface 210 is not planar and is instead rounded about the longitudinal axis 204 (i.e., the front-facing surface 210 slopes toward the first side surface and the second side surface) and is joined to the first and second side surfaces 214, 216 along beveled edges 224. The rear-facing surface 212, however, includes three regions along its length: an upper region 226, a lower region 228, and an intermediate region 230. Along the upper region 226 of the underlisting 206, the rear-facing surface 212 is rounded about the longitudinal axis 204 (i.e., the rear-facing surface 212 slopes toward the first side surface and the second side surface) and is spaced apart from the front-facing surface 210 by a maximum front-to-back width. Along the lower region 228 of the underlisting 206, the rear-facing surface 212 is planar and is spaced apart from the front-facing surface 210 by a minimum front-to-back width. Along the intermediate region 230 of the underlisting 206, which extends from the upper region 226 to the lower region 228, the front-to-back width transitions from the maximum front-to-back width to the minimum front-to-back width. The minimum front-to-back width is optionally less than 80% of the maximum front-to-back width, further optionally less than 70% of the maximum front-to-back width.

Figure 35:
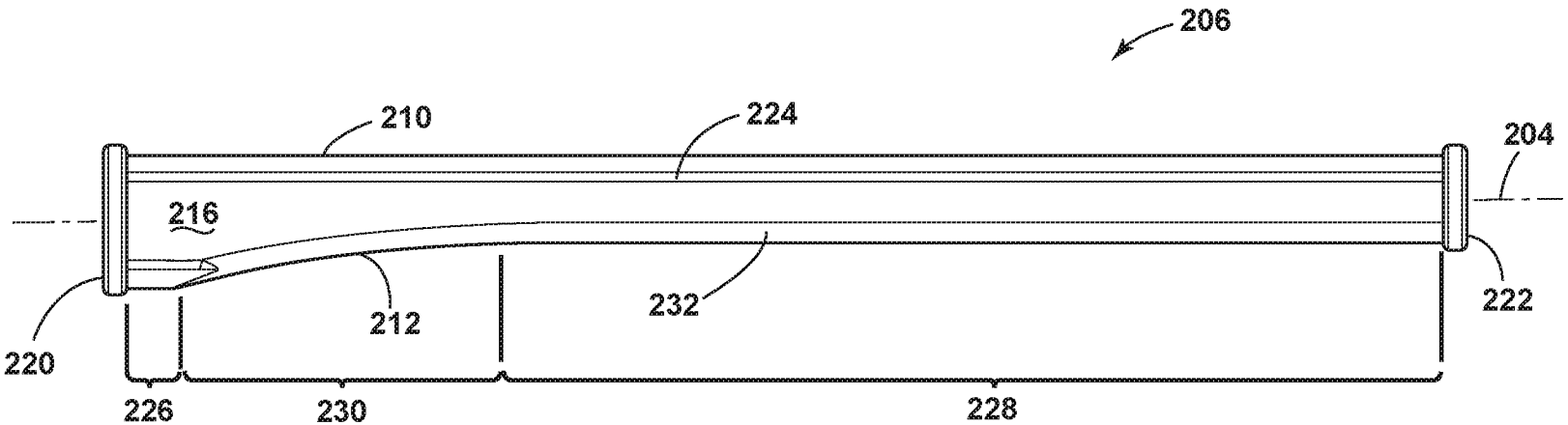
FIG. 35 is a second plan view of the putter grip of FIG. 32.
Figure 37:
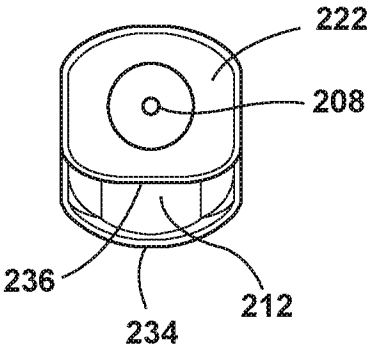
FIG. 37 is a view of the lower end of the putter grip of FIG. 32.
Figure 36:
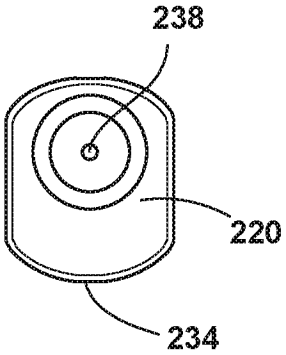
FIG. 36 is a view of the upper end of the putter grip of FIG. 32.

When viewed from the side as shown in FIG. 35, the rear-facing surface 212 includes a concave curvature within the intermediate region 230, being discontinuous with the upper region 226 but continuous with the lower region 228 (e.g., a continuous extension of the underlisting in the lower region and sharing the same rectangular cross-sectional shape). The upper region 226 of the underlisting is less than 10% of the distance between the upper end cap 220 and the lower end cap 222, further optionally 5%. The lower region 228 of the underlisting is greater than 50% of the distance between the upper end cap 220 and the lower end cap 222, further optionally 65%. Lastly, the intermediate region 230 of the underlisting is between 10% and 40% of the distance between the upper end cap 220 and the lower end cap 222, further optionally 30%. In addition, the rear-facing surface 212 is joined to the first and second side surfaces 214, 216 along beveled edges 232, similar to the beveled edges 224 joining the front-facing surface 210 to the first and second side surfaces 214, 216. The first and second side surfaces 214, 216 generally mirror each other throughout the length of the underlisting and are generally planar throughout their length. The rear-facing surface 212 in the upper region 226 of the underlisting is contoured to correspond to the convex rearward edge 234 of the upper end cap 220, while the rearward edge 236 of the lower end cap 222 is planar.

Figure 39:
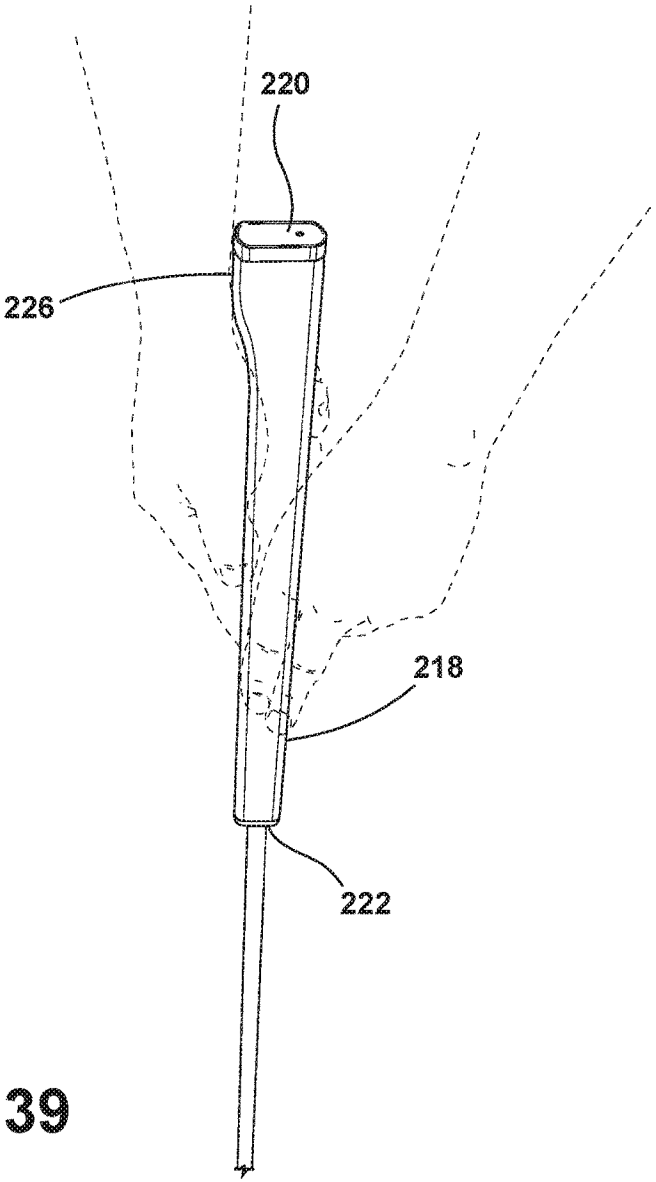
FIG. 39 is a view of the putter grip of FIG. 32 being held in the side-to-side direction for a left-hand dominant golfer.
Figure 38:
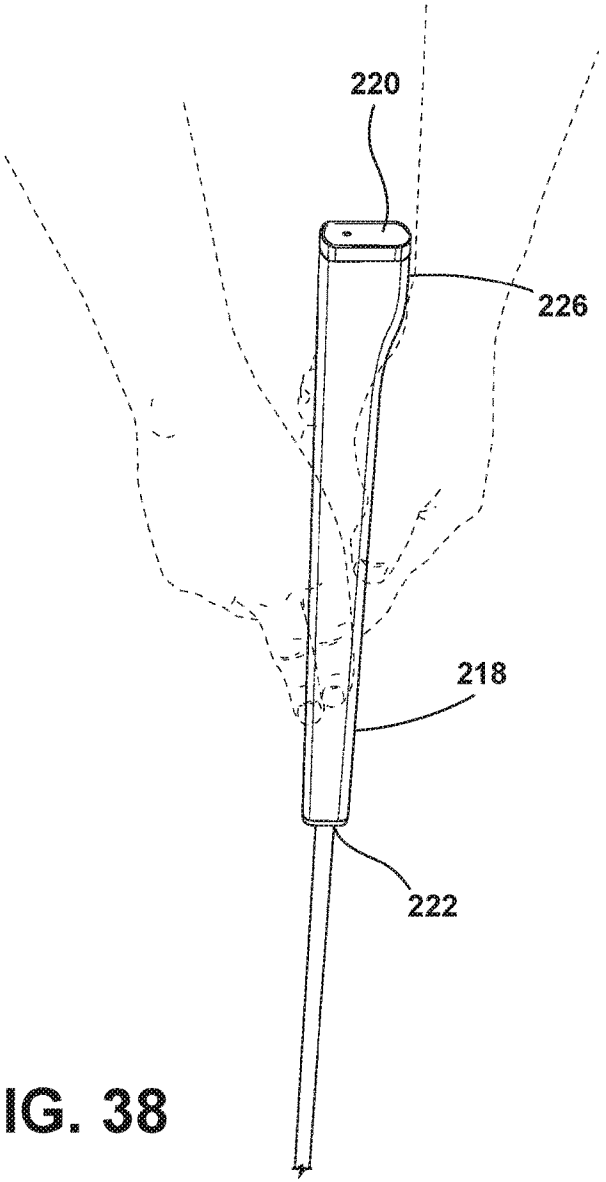
FIG. 38 is a view of the putter grip of FIG. 32 being held in the side-to-side direction for a right-hand dominant golfer.
Figure 41:
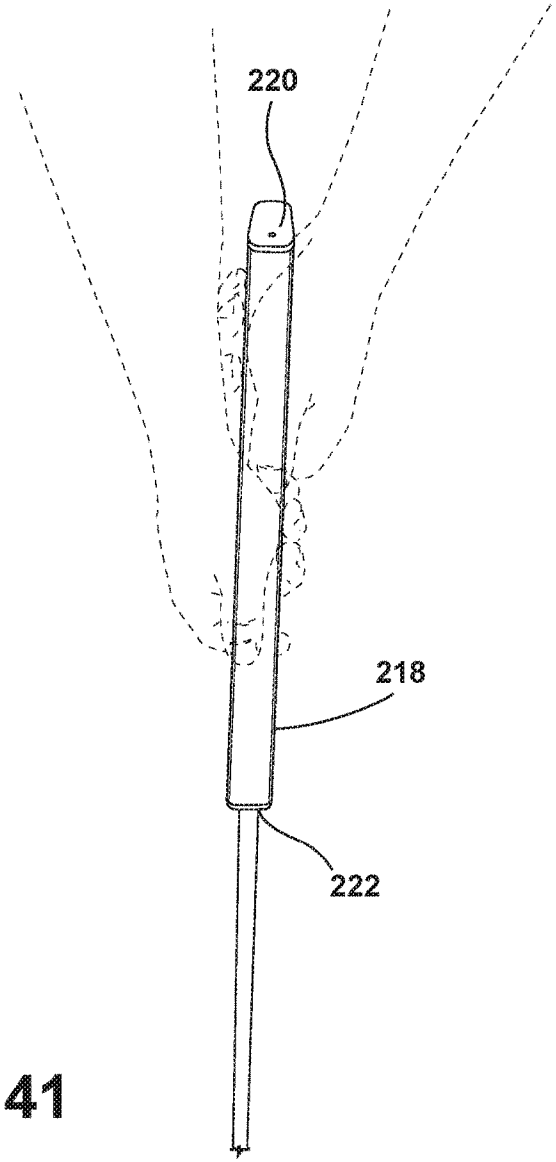
FIG. 41 is a view of the putter grip of FIG. 32 being held in the fore-to-aft direction as a pistol grip with the enlarged heel closest to the golfer.
Figure 40:
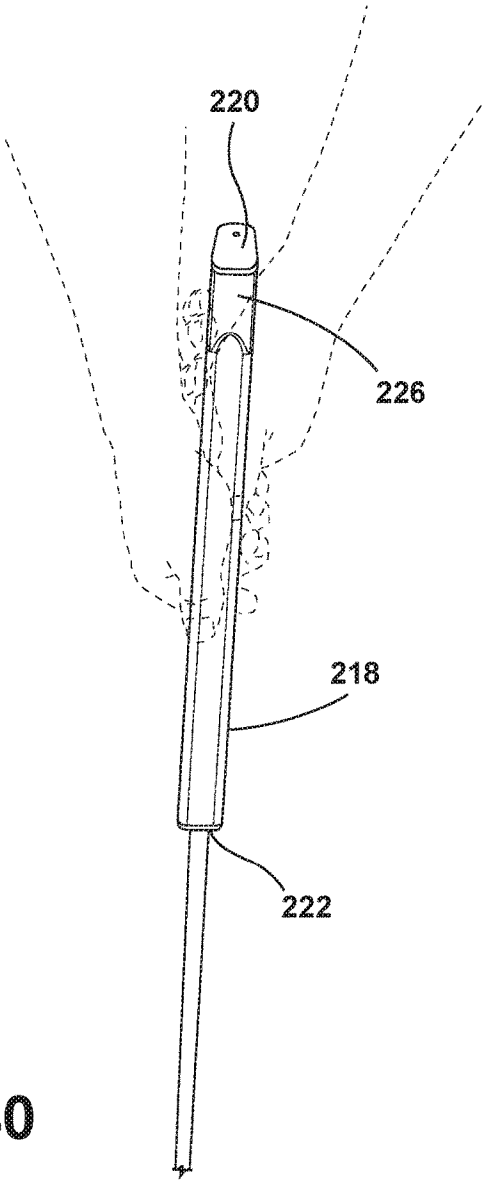
FIG. 40 is a view of the putter grip of FIG. 32 being held in the fore-to-aft direction with the enlarged heel facing away from the golfer.

The putter grip 200 is assembled to a golf shaft by introducing the golf shaft through the opening 208 in the lower end cap 222. Air may be expelled through an opening 238 in the upper end cap 220 during insertion of the golf club shaft. As shown in FIGS. 38-41, the putter grip 200 may be rotated to position the putter grip to a desired orientation with respect to a club face. As shown in FIG. 38, the putter grip 200 can be oriented such that the enlarged heel 226 engages the anterior side of the golfer's left wrist. As shown in FIG. 39, the putter grip 200 can instead be oriented such that the enlarged heel 226 engages the anterior side of the golfer's right wrist. In these orientations, the enlarged heel 226 provides a landing surface for the golfer's wrist to limit wrist flexion and wrist extension during a putting stroke. As optionally shown in FIG. 40, however, the putter grip 200 can be aligned in the fore-to-aft direction with the enlarged heel facing away from the golfer for added stability during a putting stroke. As further optionally shown in FIG. 41, the putter grip 200 can be positioned on the golf shaft as a conventional pistol grip, with the enlarged heel 226 closest to the golfer. The putter grip 200 is then fixed to the golf shaft by any method, including the use of an upper clamp assembly and a lower clamp assembly, whether now known or hereinafter developed.

The above description is that of current embodiments of the invention. While certain features of the putter grip are functional, they can be implemented in different aesthetic configurations. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular.

The invention claimed is:

1. A putter grip comprising:

an elongated handle including an upper end, a lower end, and a body therebetween, the lower end defining a shaft opening that is centered along a lengthwise axis of the elongated handle;

wherein the body of the elongated handle includes a right side surface, a left side surface, a front-facing surface, and a rear-facing surface;

wherein the right side surface and the left side surface extend parallel to a plane of symmetry that intersects the lengthwise axis of the elongated handle;

wherein the front-facing surface is rounded toward the left side surface and the right side surface along the entirety thereof between the upper end and the lower end;

wherein the rear-facing surface includes an upper portion, a lower portion, and an intermediate portion therebetween:

the upper portion being rounded toward the left side surface and the right side surface and being spaced apart from the front-facing surface by a maximum distance, the lower portion being planar and being spaced apart from the front-facing surface by a minimum distance less than the maximum distance, and the intermediate portion being a continuous extension of the lower portion and defining a concave outer curvature that terminates at the upper portion, such that the upper portion of the rear-facing surface defines an enlarged heel that mirrors the front-facing surface of the elongated handle along a portion thereof.

2. The putter grip of claim 1 wherein the elongated handle includes a textured grip sleeve surrounding a rigid underlisting.

3. The putter grip of claim 2 wherein the grip sleeve is even with the upper end of the elongated handle and the lower end of the elongated handle.

4. The putter grip of claim 1 wherein the front-facing surface is joined to the left and right side surfaces along respective beveled edges.

5. The putter grip of claim 1 wherein the upper portion of the rear-facing surface comprises less than 10% of the length of the rear-facing surface.

6. The putter grip of claim 1 wherein the lower portion of the rear-facing surface comprises at least 50% of the length of the rear-facing surface.

7. The putter grip of claim 1 wherein the intermediate portion of the rear-facing surface comprises between 10% and 40% of the length of the rear-facing surface.

8. The putter grip of claim 1 wherein the minimum distance is less than 80% of the maximum distance separating the front-facing surface from the rear-facing surface.

9. The putter grip of claim 1 wherein the intermediate portion terminates at a discontinuous edge at the upper portion.

10. The putter grip of claim 1 wherein the elongated handle includes a grip sleeve that is integrally formed with an underlisting.

11. A putter grip comprising:

a grip sleeve surrounding an underlisting to define an elongated handle, the elongated handle including an axial opening for a golf club shaft and defining a lengthwise axis therein;

wherein the elongated handle includes an upper end, a lower end, and a body having a left side surface, a right side surface, a front-facing surface, and a rear-facing surface;

wherein the left side surface is opposite of the right side surface, and wherein the left side surface and the right side surface are substantially planar;

wherein the front-facing surface is rounded about the lengthwise axis of the elongated handle along the entirety thereof between the upper end and the lower end;

wherein the rear-facing surface includes an upper portion, a lower portion, and an intermediate portion therebetween:

the upper portion being rounded about the lengthwise axis of the elongated handle and being spaced apart from the front-facing surface by a maximum distance, the lower portion being planar and being spaced apart from the front-facing surface by a minimum distance less than the maximum distance, the intermediate portion being a continuous extension of the lower portion and defining a concave curvature that terminates at the upper portion, such that the upper portion of the rear-facing surface defines an enlarged heel that mirrors the front-facing surface of the elongated handle along a portion thereof.

12. The putter grip of claim 11 wherein the front-facing surface is joined to the left and right side surfaces along respective beveled edges.

13. The putter grip of claim 11 wherein the upper portion of the rear-facing surface comprises less than 10% of the length of the rear-facing surface.

14. The putter grip of claim 11 wherein the lower portion of the rear-facing surface comprises at least 50% of the length of the rear-facing surface.

15. The putter grip of claim 11 wherein the intermediate portion of the rear-facing surface comprises between 10% and 40% of the length of the rear-facing surface.

16. The putter grip of claim 11 wherein the minimum distance is less than 80% of the maximum distance separating the front-facing surface from the rear-facing surface.

17. The putter grip of claim 11 wherein the intermediate portion terminates at a discontinuous edge at the upper portion.

18. The putter grip of claim 11 wherein the left side surface and the right side surface extend parallel to a plane of symmetry that intersects the lengthwise axis of the elongated handle.

19. The putter grip of claim 11 wherein the grip sleeve is even with the upper end and the lower end of the elongated handle.

20. The putter grip of claim 11 wherein the grip sleeve that is integrally formed with the underlisting.

* * * * *